US006827211B1

(12) United States Patent
Lee

(10) Patent No.: US 6,827,211 B1
(45) Date of Patent: Dec. 7, 2004

(54) HARDWARE PACKING CASE STRUCTURE

(76) Inventor: Shih-Lin Lee, No. 22, Lane 81 Sec. 2, Tunhwa S. Rd., Taipei (TW)

( * ) Notice: Subject to any disclaimer, the term of this patent is extended or adjusted under 35 U.S.C. 154(b) by 16 days.

(21) Appl. No.: 10/463,345

(22) Filed: Jun. 18, 2003

(51) Int. Cl.[7] ..... A45C 11/26
(52) U.S. Cl. ..... 206/349; 206/45.25; 206/471
(58) Field of Search ..... 206/303, 305, 206/395, 349, 408, 409, 411, 461, 471, 45.25, 45.26; 242/532.6, 539

(56) References Cited

U.S. PATENT DOCUMENTS 2,217,397 A * 10/1940 Armitt ..... 206/395
3,129,810 A * 4/1964 Wilkens ..... 242/532.6
3,155,232 A * 11/1964 Leone ..... 206/476
3,258,114 A * 6/1966 King ..... 206/738
3,459,298 A * 8/1969 Quenot ..... 206/305
5,622,258 A * 4/1997 Baublitz et al. ..... 206/349

* cited by examiner

*Primary Examiner*—David T. Fidei
(74) *Attorney, Agent, or Firm*—Rosenberg, Klein & Lee

(57) ABSTRACT

A hardware packing case structure is provided. The front end of the packing case is designed to be an entrance, and areas of the left and right side-plates are different and the areas of the bottom and the covering plates are also different. Moreover, a position hole is set at the left side-plate for clamping the clamping apparatus at a side of the hardware so as to stably fix the hardware in the packing case, and therefore the hardware will not fall out easily. Furthermore, through an entrance at a front end of the packing case, the front end of the hardware will be exposed to show the appearance and type thereof for the buyer.

5 Claims, 8 Drawing Sheets

HARDWARE PACKING CASE STRUCTURE

BACKGROUND OF THE INVENTION

1. Field of the Invention

The present invention relates to a hardware packing case structure, and more particularly to a hardware packing case structure which can stably fix and orientate a hardware therein.

2. Description of the Prior Art

Generally, the conventional hardware packing case includes a bottom plate and a transparent plastic covering plate. The transparent plastic covering plate includes containers thereon whose sizes are identical to those of the hardware for positioning the hardware. When packing, the peripheral edges of the plastic covering plate that contains the hardware in the containers are pasted on the bottom plate so as to seal the hardware in the containers of the plastic covering plate. Then, when the user wants to use the hardware, he just needs to tear the plastic covering plate away from the bottom plate to take out the hardware. However, the plastic covering plate actually does not conform to the environmental consciousness which is highly considered today.

Thus, it can be seen, the prior art described above still has some defects, is not a good design, however, and is urgently to be improved.

Because of the technical defects of described above, the applicant keeps on carving unflaggingly to develop a hardware packing case structure through wholehearted experience and research.

SUMMARY OF THE INVENTION

An object of the present invention is to provide a hardware packing case structure which is formed through folding a paper matrix so as to conform to the environmental consciousness.

Another object of the present invention is to provide a hardware packing case structure, wherein a position hole is mounted at a center portion of a left side-plate thereof for positioning a clamping apparatus located at a side of the hardware so as to simultaneously fix the hardware in the packing case stably as packing thereof.

Another further object of the present invention is to provide a hardware packing case structure whose front end is designed to be an entrance so that a front end of the hardware can be exposed to show thereof.

For achieving the purposes described above, the hardware packing case structure according to the present invention includes an integrally formed paper matrix having plural horizontal and vertical folding lines thereon so as to be divided into a bottom plate, a covering plate, a left and a right side-plates, a back side-plate, an inserting plate, two inward folding plates and a tongue plate. After each plate is folded along the folding lines, a packing case will be formed. Meanwhile, an entrance will be formed at the front end of the packing case for exposing a front end of the hardware, and furthermore, a position hole set at a center portion of the left side-plate will clamp a clamping apparatus at a side of the hardware so that the hardware will be fixed in the packing case and will not fall out easily. Therefore, the hardware can be fixed and orientated stably in the packing case so as to achieve a positioning function.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1A:
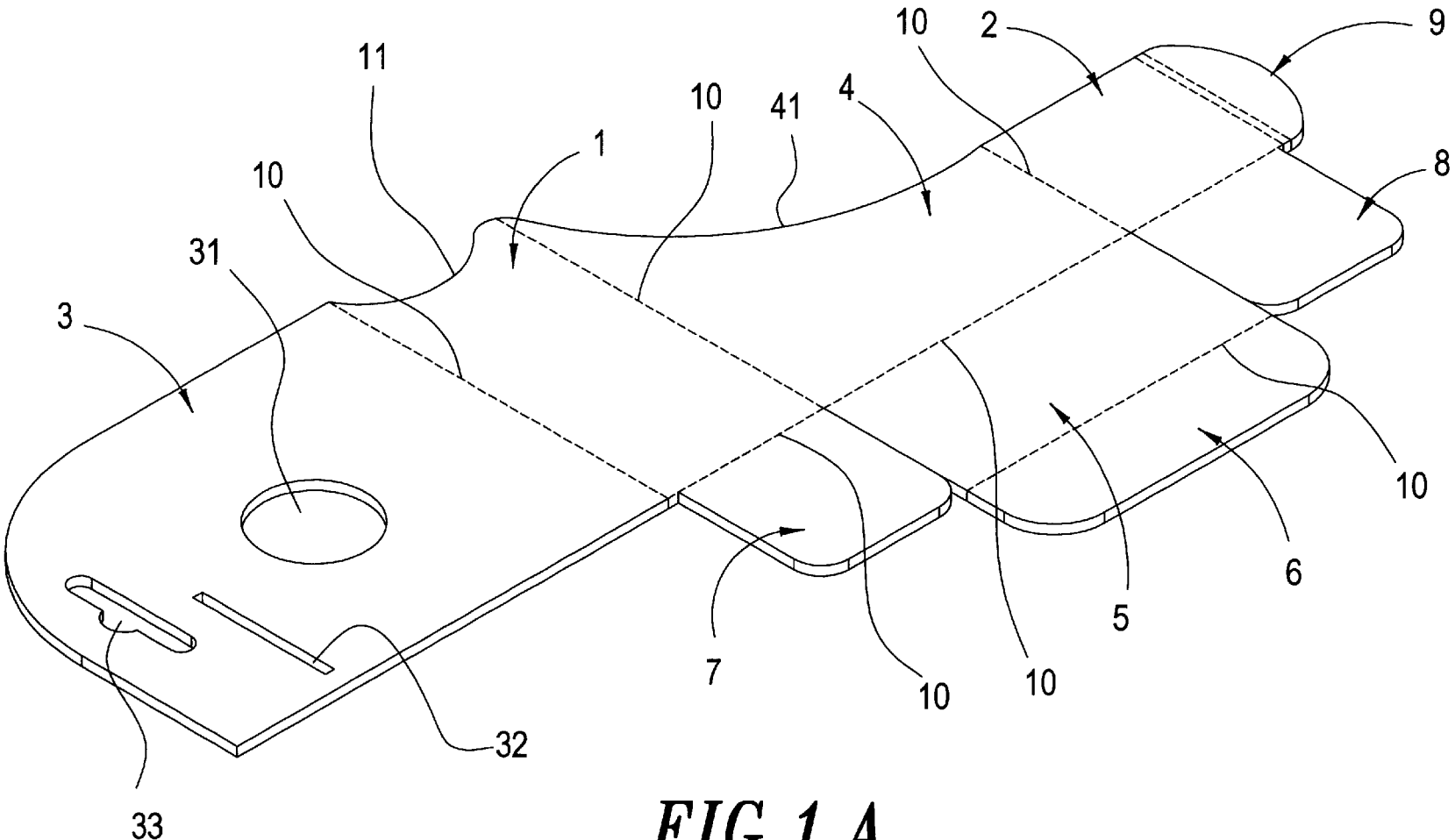
FIGS. 1A~1F are fabricating schematic views showing the hardware packing case structure according to the present invention.
Figure 1B:
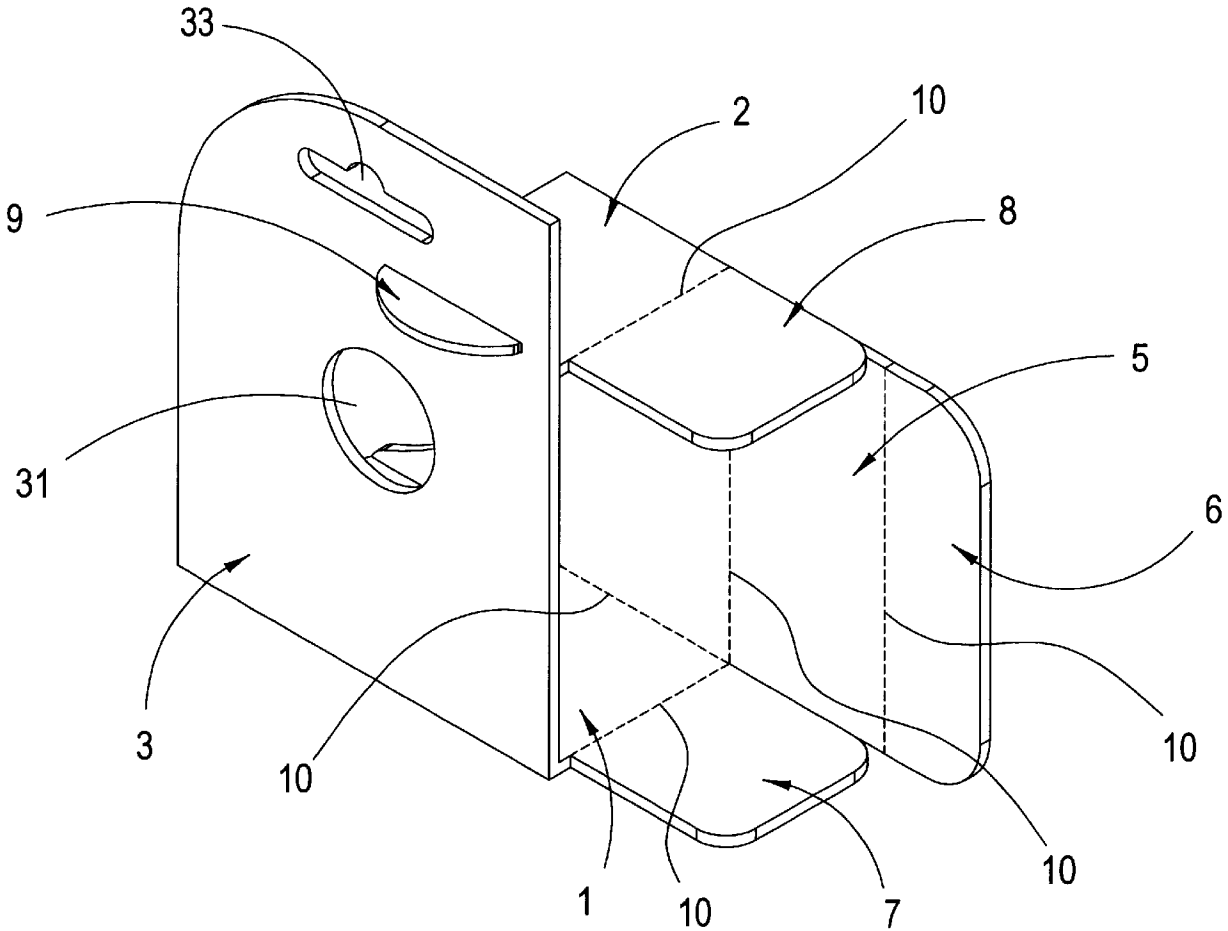
Figure 1C:
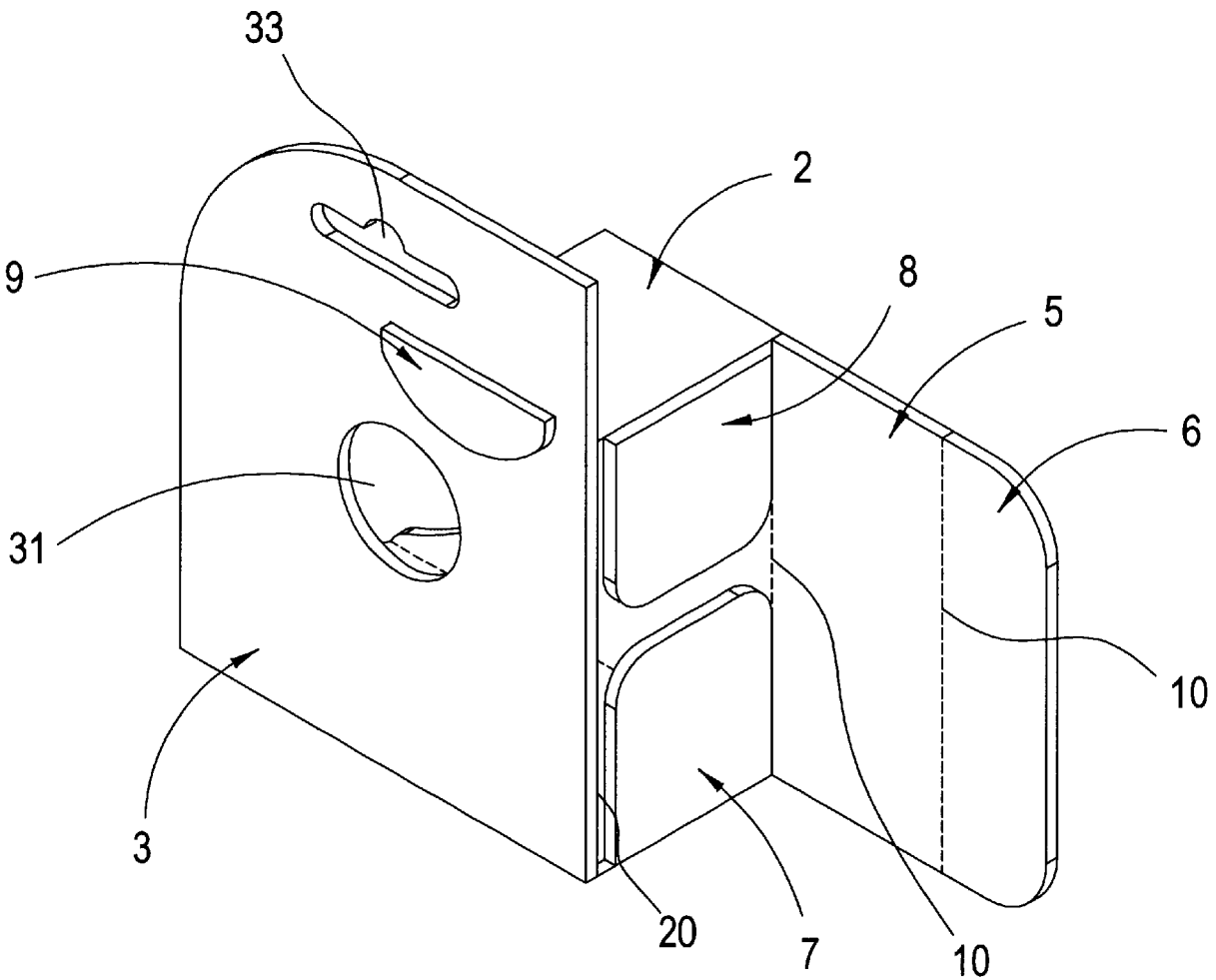
Figure 1D:
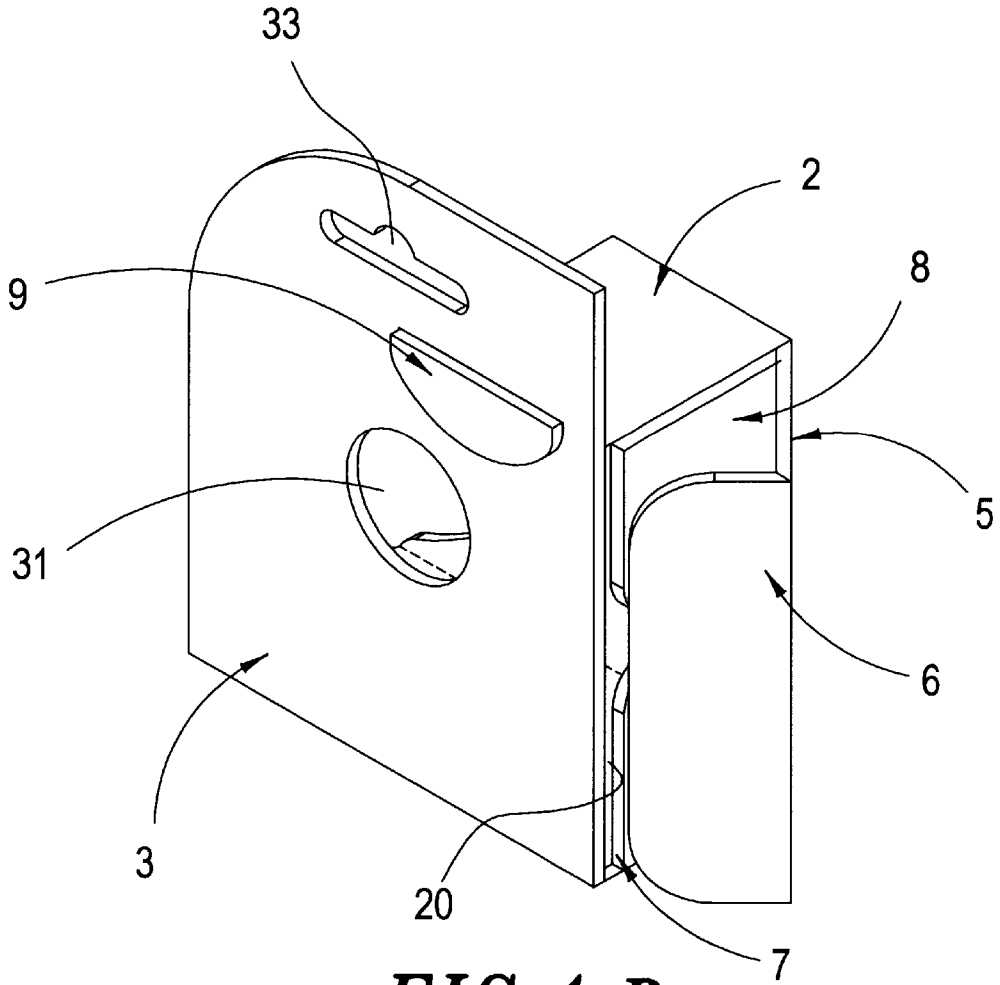
Figure 1E:
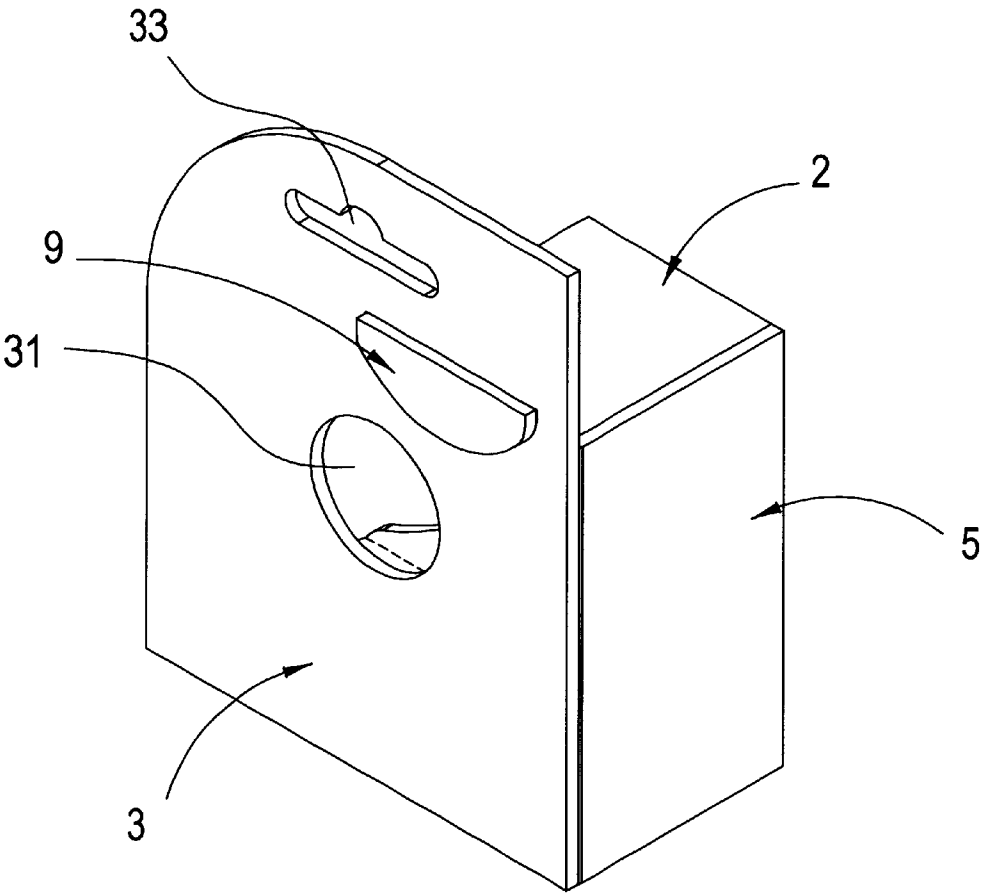
Figure 1F:
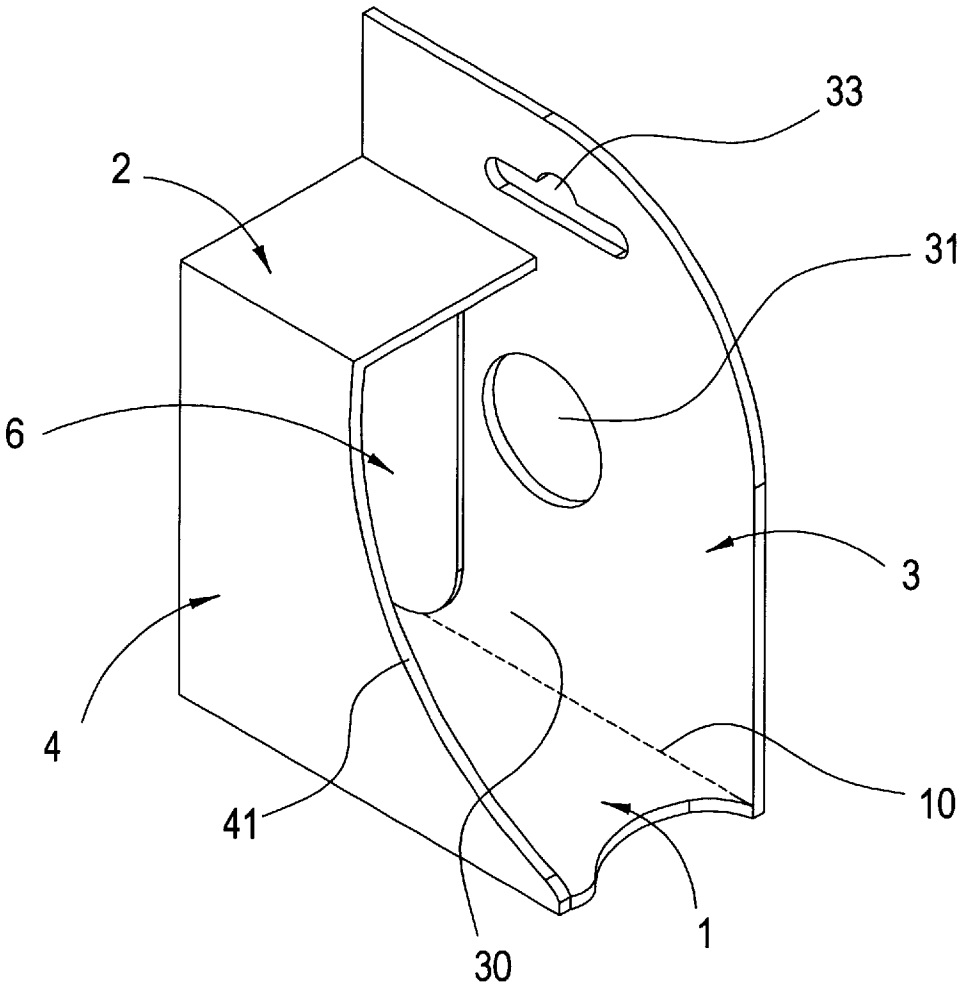

Please refer to FIGS. 1A~F which show the hardware packing case structure according to the present invention. The hardware packing case structure is formed from an integrally formed paper matrix having plural horizontal and vertical folding lines thereon, and the paper matrix is therefore divided into a bottom plate 1, a covering plate 2, a left side-plate 3, a right side-plate 4, a back side-plate 5, an inserting plate 6, a first inward folding plate 7, a second inward folding plate 8 and a tongue plate 9. A back side of the bottom plate 1 is connected to the first inward folding plate 7 and a front end thereof is a concave arc 11. The left side-plate 3 is connected to a left side of the bottom plate 1 and has a position hole 31 mounted at a center portion thereof, a plug hole 32 set at an end of a top thereof and a opening 33 set at an bevel area between the top and the plug hole 32, wherein the opening 33 serves as a hook. The right side-plate 4 is connected to a right side of the bottom plate 1 and the front end thereof is formed to be a concave arc 41 so that an area of the right side-plate 4 is different from that of the left side-plate 3. A front side of the back side-plate 5 is connected to a back side of the right side-plate 4 and a back side thereof is connected to the inserting plate 6. The covering plate 2 is connected to a right side of the right side-plate 4 and has a different area from the bottom plate 1, and further, the covering plate 2 is connected to the second inward folding plate 8 through a back side thereof and connected to the tongue plate 9 though a right side thereof.

When fabricating, the left side-plate 3 and the right side-plate 4 are bent 90 degrees respectively along the folding lines 10 between the bottom plate 1 and the right and the left side-plates 3 and 4, the covering plate 2 is bent 90 degrees toward the left side-plate 3 along the folding line 10 between the right side-plate 4 and the covering plate 2 so as to insert and wedge the tongue plate 9 into the plug hole 32 of the left side-plate 3, and the tongue plate 9 is bent downward so as to close to an outer wall of the left side-plate 3. So far, the bottom plate 1, the covering plate 2, the left side-plate 3 and the right side-plate 4 are positioned. Then, the first and the second inward folding plates 7 and 8 are bent 90 degrees respectively toward the covering plate 2 and the bottom plate 1 so as to form a slit 20 through cooperating with the left side-plate 3, then the back side-plate 5 is bent 90 degrees along the folding line 10 between the right side-plate 4 and the back side-plate 5 so that the inserting plate 6 is bent and wedged into the slit 20 formed by the left side-plate 3 and the first and the second inward folding plates 7 and 8, and therefore a back side of the packing case can be stably closed by the back side-plate 5 so as to form the packing case 100 for packing a hardware. Furthermore, because a front side-plate is not included, the front end of the packing case 100 is designed as an entrance 30.

Figure 2A:
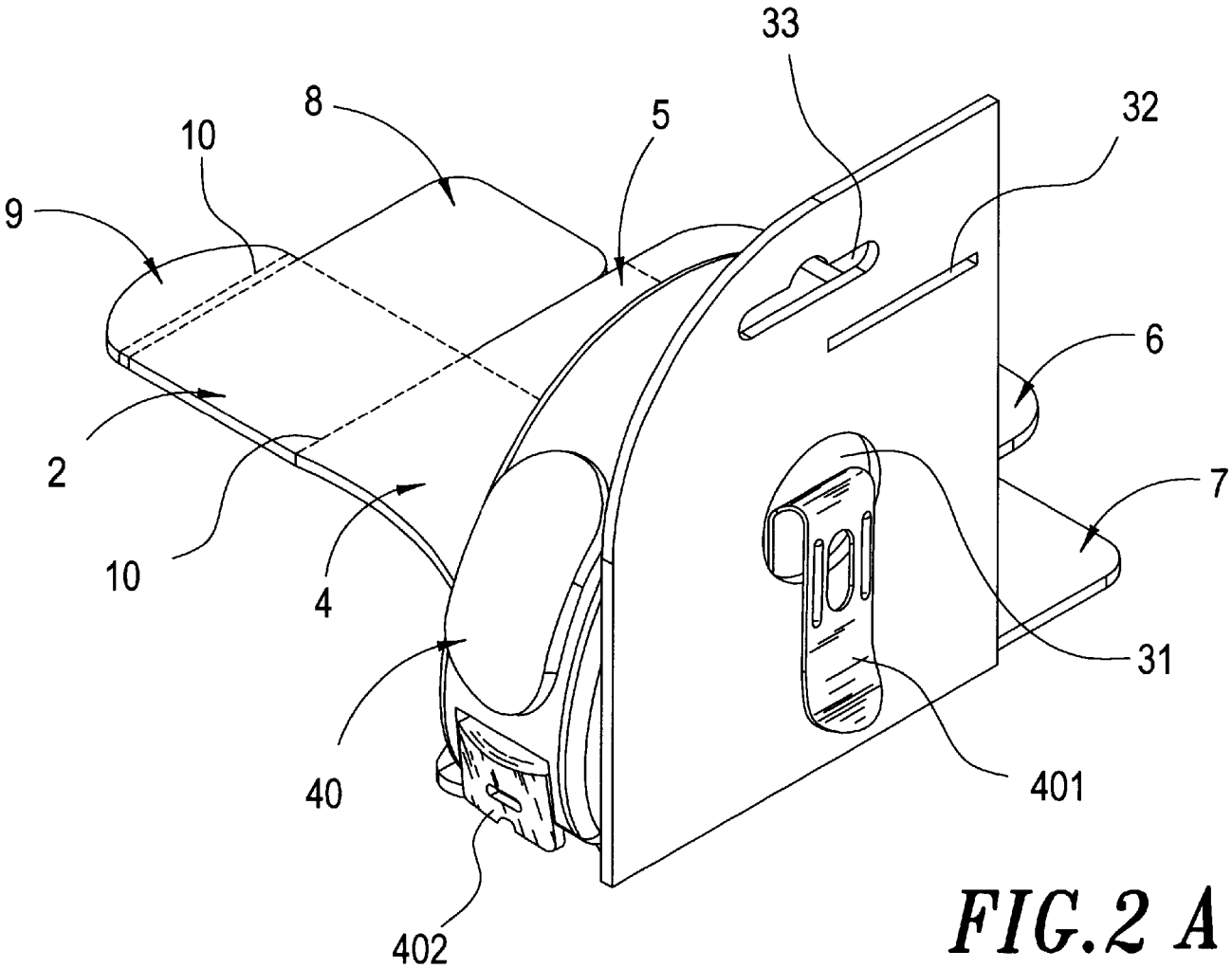
FIGS. 2A~2B are practicing schematic views showing the hardware packing case structure according to the present invention.
Figure 2B:
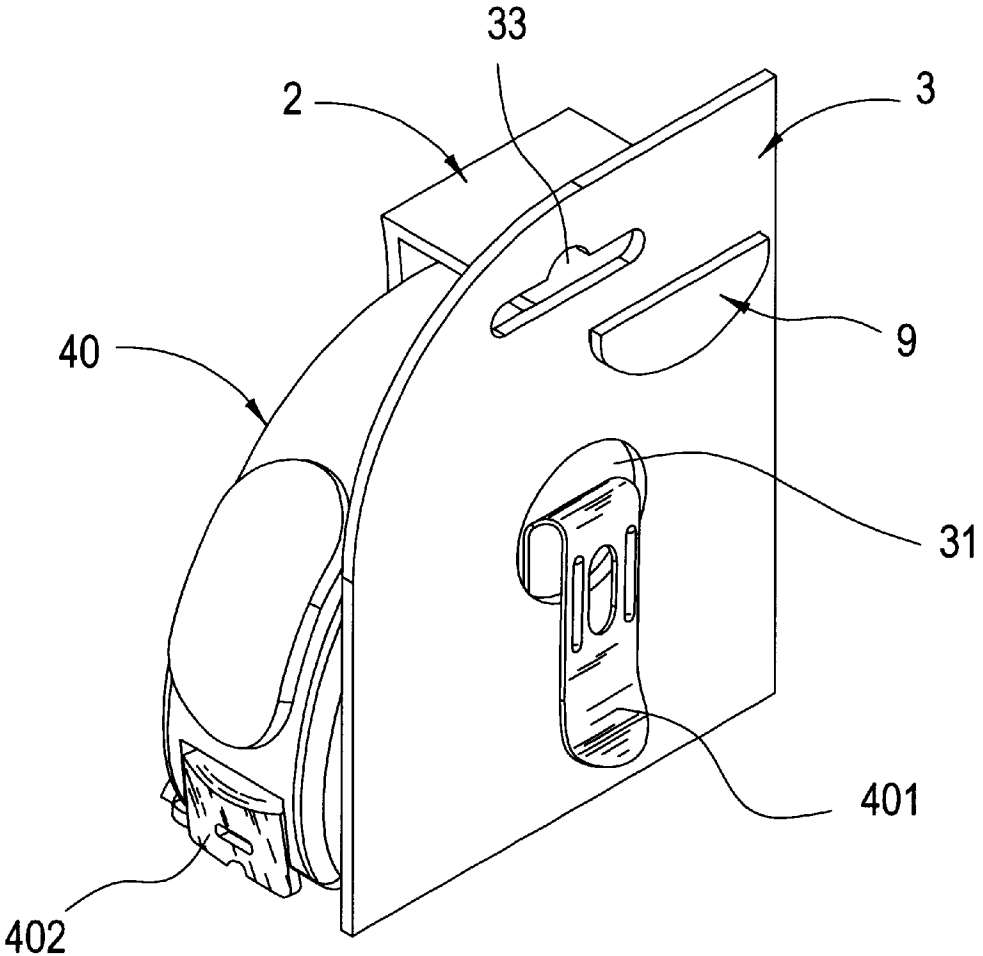

Please further refer to FIGS. 2A~B, which show the practicing schematic views according to the present invention. As shown in FIG. 2 which illustrates the packing of a measuring tape 40, when packing the measuring tape 40, a clamping apparatus 401 at a side of the measuring taper 40 is previously clamped with the position hole 31 of the left side-plate 3 under a non-fabricated condition so that the measuring tape 40 will stay close with an inner wall of the left side-plate 3. Then, through the fabricating method described above, the measuring tape 40 can be packed and positioned in the packing case 100 and will not fall out easily. Furthermore, through the entrance 30 in front of the packing case 100, the front end of the measuring tape 40 will be exposed so that the buyer can easily see the appearance of the measuring tape 40 to determine if the measuring tape is worth to buy. Besides, the tape head 402 at the bottom of the measuring tape 40 will be rejected against the concave arc 11 at the front end of the bottom plate 1. When the user tries to take the measuring tape 40 apart the packing case 100, the measuring tape 40 can be taken out directly or the user can dismantle the packing case 100 firstly and then depart the clamping apparatus 401 from the position hole 31, therefore the measuring tape 40 can be taken out.

Otherwise, the packing case can be completed previously and then the measuring tape is putted thereinto through the entrance located at the front end of the packing case and fixed through the combination between the clamping apparatus and the position hole.

The hardware packing case structure according to the present invention, when being compared with the other prior arts, further includes the advantages as follows:

1. The present invention provides a hardware packing case structure which is formed though folding a paper matrix so as to conform to the environmental consciousness.
2. The present invention provides a hardware packing case structure which has a position hole mounted at a center portion of a left side-plate thereof for positioning a clamping apparatus located at a side of the hardware so as to simultaneously fix the hardware in the packing case stably as packing thereof.
3. The present invention provides a hardware packing case structure whose front end is designed to be an entrance so that a front end of the hardware can be exposed to show the appearance thereof and achieve a pleasing effect.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A hardware packing case structure comprising an integrally formed paper matrix having plural horizontal and vertical folding lines so that said paper matrix is divided into:

a bottom plate having a first inward folding plate connected to a back side thereof;

a left side-plate connected to a left side of said bottom plate and having a position hole set at a center portion thereof and a plug hole set at an end of a top thereof;

a right side-plate connected to a right side of said bottom plate;

a covering plate connected to a right side of said right side-plate, a second inward folding plate through a back side thereof and a tongue plate through a right side thereof; and a back side-plate connected to a back side of said right side-plate through a front side thereof and an inserting plate through a back side thereof, thereby when fabricating, said left and said right side-plates are folded along said folding lines respectively located between said bottom plate and said right and said left side-plates so that they are parallel to each other, said covering plate is bent toward said left side-plate along said folding line between said right side-plate and said covering plate so as to insert and wedge said tongue plate into said plug hole of said left side-plate, said tongue plate is bent downward so as to close to an outer wall of said left side-plate, said first and said second inward folding plates are bent toward each other and cooperate with said left side-plate to form a slit located at an edge of said left side-plate, and said back side-plate is bent along said folding line between said right side-plate and said back side-plate so that said inserting plate is bent and wedged into said slit formed by said left side-plate and said first and said second inward folding plates and a back side of said packing case is closed thereby so as to form said packing case for packing a hardware.

2. The hardware packing case structure according to claim 1, wherein said left side-plate further comprises an opening mounted at a bevel area between said plug hole and said top of said left side-plate for providing a position to said completely fabricated packing case to be hooked on a hook.

3. The hardware packing case structure according to claim 1, wherein a front side of said right side-plate is a concave arc so that an area thereof is different from that of said left side-plate so as to cause said covering plate and said bottom plate have different areas.

4. The hardware packing case structure according to claim 1, wherein said packing case has an entrance at a front side thereof after being fabricated.

5. The hardware packing case structure according to claim 1, wherein said hardware is a measuring tape.

* * * * *